United States Patent [19]

Nakamura et al.

[11] 4,410,768

[45] Oct. 18, 1983

[54] ELECTRO-ACOUSTIC TRANSDUCER

[75] Inventors: Akira Nakamura, Shizuoka; Takao Nakaya, Hamamatsu, both of Japan

[73] Assignee: Nippon Gakki Seizo Kabushiki Kaisha, Hamamatsu, Japan

[21] Appl. No.: 283,367

[22] Filed: Jul. 15, 1981

[30] Foreign Application Priority Data

| | | | |
|---|---|---|---|
| Jul. 23, 1980 | [JP] | Japan | 55-100857 |
| Jul. 23, 1980 | [JP] | Japan | 55-100858 |
| Jul. 23, 1980 | [JP] | Japan | 55-104211[U] |
| Jul. 30, 1980 | [JP] | Japan | 55-103712 |

[51] Int. Cl.[3] ..... H04R 7/00; H04R 9/00

[52] U.S. Cl. ..... 179/115.5 R; 179/115.5 DV; 179/115.5 VC; 179/181 R; 179/181 F; 181/167; 181/169; 181/170

[58] Field of Search ..... 181/169, 167, 170; 179/115.5 DV, 115.5 VC, 115.5 R, 181 R, 181 F; 428/318.6, 314.4, 319.3

[56] References Cited

U.S. PATENT DOCUMENTS

| | | | |
|---|---|---|---|
| 3,033,945 | 5/1962 | Villchur | 179/181 F |
| 3,111,187 | 11/1963 | Barlow | 179/181 F |
| 3,930,130 | 12/1975 | Baszor | 181/169 |
| 4,042,746 | 8/1977 | Hofer | 428/314.4 |
| 4,315,557 | 2/1982 | Nakaya et al. | 181/169 |
| 4,344,503 | 8/1982 | Nakamura et al. | 181/170 |

FOREIGN PATENT DOCUMENTS

| | | | |
|---|---|---|---|
| 52-2723 | 1/1977 | Japan | 181/167 |
| 52-65421 | 5/1977 | Japan | 181/169 |
| 55-956 | 1/1980 | Japan | 181/167 |
| 55-7756 | 2/1980 | Japan | 181/167 |
| 55-32317 | 8/1980 | Japan | 181/169 |
| 6089199 | 7/1981 | Japan | 179/115.5 VC |
| 197809 | 9/1978 | United Kingdom | 181/170 |

OTHER PUBLICATIONS

*Product Engineering*, "Simple Plastic Process Yields High Performance Cellular Cores", Aug. 1973, pp. 40–41.

Calvin J. Binning, *Plastic Foams: The Physics and Chemistry of Product Performance and Process Technology*, John Wiley & Sons, 1969, p. 14.

*Primary Examiner*—G. Z. Rubinson
*Assistant Examiner*—Danita R. Byrd
*Attorney, Agent, or Firm*—Spensley, Horn, Jubas & Lubitz

[57] ABSTRACT

In an electro-acoustic transducer in a loud speaker and like devices, a diaphragm and/or a voice coil bobbin is or are formed by a composite material consisting of a foamed resin containing reinforcing fibers. Such diaphragm has a large Young's modulus-to-density ratio $E/\rho$, a large internal loss $\tan\delta$ and a large flexural rigidity E.I, and thus it exhibits good characteristics in sound reproducing. Such voice coil bobbin which is an electric insulator can have a small thickness and is light in weight and has a large mechanical strength, and thus it is free from adversely affecting the vibration of the diaphragm, and accordingly, the sound reproduced.

25 Claims, 12 Drawing Figures

ELECTRO-ACOUSTIC TRANSDUCER

BACKGROUND OF THE INVENTION (a) Field of the Invention

The present invention relates to electro-acoustic transducers, and more particularly, it pertains to an electro-acoustic transducer for use in loudspeakers, earphones or like devices, which uses, at least locally of its vibration system, a composite material having an extremely good acoustic characteristic.

(b) Description of the Prior Art

A known prior art electro-dynamic type speaker, in general, is constructed by a magnetic circuit system and a vibration system which is vibratably supported, by a suspension means, on a frame in such manner that its voice coil is positioned to lie in the magnetic gap of the magnetic circuit system. This vibration system is comprised of a diaphragm, a voice coil bobbin which is secured to the diaphragm, and a voice coil wound around the voice coil bobbin.

The material with which the diaphragm generally is made requires to be light in weight and to have a large $E/\rho$ (ratio between Young's modulus E and density $\rho$), a large flexural rigidity E·I (wherein: E represents Young's modulus, and I represents second moment of section), and a large internal loss tan $\delta$. More particularly, in a diaphragm, the larger the $E/\rho$ ratio is, the higher will become the resonance frequency, and accordingly the range of piston motion of the diaphragm will expand more. Thus, the frequency range of the speaker becomes broadened. Also, as E·I becomes greater, the distortions contained in the reproduced sound will accordingly decrease. Furthermore, as the internal loss tan $\delta$ increases, the value Q of the partial resonance of the diaphragm will decrease. Thus, it is possible to materialize flatness in the frequency characteristics of the diaphragm, i.e. it is possible to eliminate uneven colorification of the reproduced sound.

It is for the foregoing reasons that selection of constituent material of diaphragm becomes important. In the past, there has been used a paper sheet, or a thin film or foil made of a light metal having a large Young's modulus, such as aluminum (Al), boron (B), beryllium (Be), magnesium (Mg) or titanium (Ti), or a thin film of ceramics such as alumina ($Al_2O_3$).

However, a paper sheet which is used in a diaphragm has the drawback that it has a small $E/\rho$ ratio.

In contrast thereto, a light metal as listed above, while having a relatively large $E/\rho$ ratio, has a very vmall internal loss tan $\delta$ of 0.01 or smaller. Thus, the overall internal loss of the whole diaphragm is small, causing a peak or a dip to appear in its frequency characteristic, and no desirable frequency characteristic can be obtained. Therefore, a diaphragm using such metal film or foil has the drawback that uneven colorification develops. On the other hand, a ceramic film has the advantage that it has a large $E/\rho$ ratio and its manufacturing cost is low, but it has problems in its processability and handling because of its fragility. For reasons stated above, each of these known materials has both strong points and weak points, and accordingly, it has not been possible to obtain a satisfactory diaphragm from the use of these materials.

Also, the material of a voice coil bobbin is required to be light in weight and to have such mechanical strength as will not develop deformation in itself during vibration. With respect specially to the mechanical strength of a voice coil bobbin, the selection of its material has become important in view of the recent increased demand for large output speakers.

In the past, paper sheet has been most widely used to realize voice coil bobbins. In view of the incapability of paper sheet to satisfy the abovesaid requirements, there have been proposed a voice coil bobbin which is made of various materials other than paper, such as a synthetic resin, e.g. polyamide resin, having an excellent resistance to heat, or light metal film or foil such as aluminum or duralumin.

However, a voice coil bobbin made of a synthetic resin is such that it has a too small Young's modulus and thus it lacks flexural rigidity to be used for the purpose of reproducing large outputs.

On the other hand, a voice coil bobbin made of a light metal film or foil such as aluminum or duralumin substantially satisfies the mechanical strength requirement. However, it has the big deficit that, in view of its being a good electric conductor, it gives rise to eddy current due to its vibration within the magnetic gap, and this, in turn, serves to work as a braking force to the vibration of the voice coil, with the result that the reproduced sound is adversely affected.

SUMMARY OF THE INVENTION

A basic object of the present invention is to provide an electro-acoustic transducer provided with a vibration system having an excellent acoustic characteristic.

A first object of the present invention, therefore, is to provide an electro-acoustic transducer as described above, which is provided with a diaphragm having an improved $E/\rho$ ratio.

A second object of the present invention is to provide an electro-acoustic transducer provided with a diaphragm having an improved internal loss tan $\delta$.

A third object of the present invention is to provide an electro-acoustic transducer provided with a diaphragm having an improved flexural rigidity E·I.

A fourth object of the present invention is to provide an electro-acoustic transducer having an expanded frequency reproduction range.

A fifth object of the present invention is to provide an electro-acoustic transducer having a flat frequency characteristic.

A sixth object of the present invention is to provide an electro-acoustic transducer which is capable of making reproduction of sound with reduced distortion.

A seventh object of the present invention is to provide an electro-acoustic transducer provided with a voice coil bobbin having such sufficient mechanical strength so as not to develop deformation of the bobbin per se, and allowing itself to be made thin and light in weight.

An eighth object of the present invention is to provide an electro-acoustic transducer provided with a voice coil bobbin having a sufficient mechanical strength and free of development of eddy current.

DETAILED DESCRIPTION OF THE PREFERRED EMBODIMENTS

Figure 1:
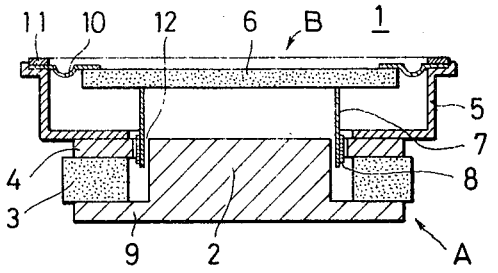
FIG. 1 is a diagrammatic vertical sectional view of a loud speaker arrangement, showing a first embodiment of the present invention.

In FIG. 1 which shows a first embodiment of the loud speaker arrangement according to the present invention, reference numeral 1 represents a loud speaker which is comprised of a magnetic circuit system A formed with a pole piece 2, a magnet 3 and a top yoke 4; a vibration system B which includes a diaphragm 6, a voice coil bobbin 7 and a voice coil 8; and a frame 5. The pole piece 2 is provided with an annular bottom yoke 9 formed on the peripheral portion of one end of the pole piece 2 integrally therewith. The magnet 3 and the top yoke 4 are laminated, in this order, on top of the bottom yoke 9 in coaxial fashion, and they are bonded together by a bonding agent.

The diaphragm 6 is formed into, for example, a disk shape with a material which will be described later. The peripheral marginal portion of this diaphragm 6 is fixed to an upper end edge portion of the frame 5 via a suspension member 10. Numeral 11 represents a gasket which utilized to fix the suspension member 10 to the frame 5.

Figure 2:
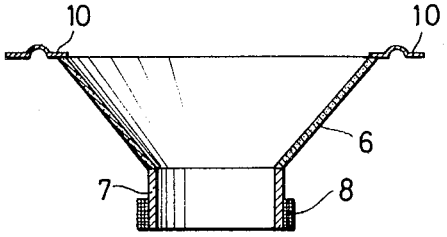
FIGS. 2 and 3 are diagrammatic vertical sectional views, showing modifications of the diaphragm of the loud speaker shown in FIG. 1.
Figure 3:
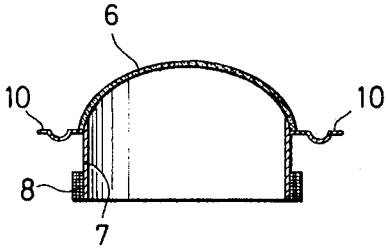

On the other hand, the voice coil bobbin 7 has its one end bonded to the rear side of the diaphragm 6, and the other end inserted in a magnetic gap 12 formed between the pole piece 2 and the top yoke 4. The voice coil 8 is would around this other end of the voice coil bobbin 7. Accordingly, when a signal-carrying electric current is caused to flow through this voice coil 8, the voice coil bobbin 7 carrying the voice coil 8 is driven to vibrate the diaphragm 6. It should be understood here that the shape of the diaphragm 6 is not limited to a disk shape, but it may be a cone shape as shown in FIG. 2, or a dome shape as illustrated in FIG. 3.

Figure 4:
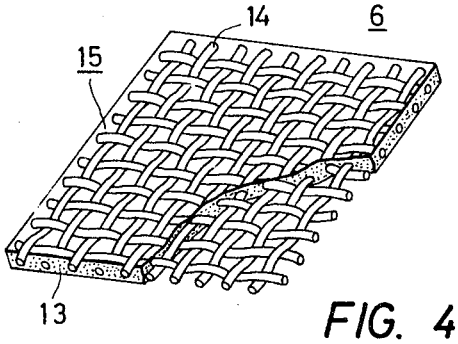
FIG. 4 is a diagrammatic enlarged perspective view of an essential portion of the diaphragm of the loud speaker shown in FIG. 1.

As the material of the diaphragm 6, there is employed a composite board 15 formed with a closed cellular plastics 13 and its reinforcing fibers 14 as shown in FIG. 4. The plastics material 13 is selected from the group of thermosetting resins consisting of epoxy resin, non-saturated polyester resin, phenolic resin and polyimid resin, and also from the group of thermoplastic resins consisting of polyamide resin, polyethylene resin, polypropylene resin, polystyrene resin, polyvinyl chloride resin and acrylonitrile-butadiene-styrene resin. Such a resin as mentioned above is caused to foam by the use of a foaming agent at the time of molding the diaphragm 6, to provide a closed cellular plastics having closed cells. For example, the use of a foaming agent such as azodicarbonamide or dinitrosopentamethylene-tetramine is suitable for epoxy resin. It should be understood here that the plastics 13 may alternatively be comprised of open cellular plastics as well.

On the other hand, the reinforcing fibers 14 for the plastics 13 are selected from fibers having a high tensile strength and a high mechanical strength, such as carbon fibers, glass fibers, silicon carbide fibers, boron fibers, graphite fibers, and organic high modulus fibers such as aromatic polyamide fibers. Of all these, the use of carbon fibers is most desirable. These fibers usually have a diameter ranging from several micrometers to ten and several micrometers. The fibers need not be provided in the form of woven fabric, but they may be prepared in the form of a non-woven fabric.

Next, the physical property of the diaphragm of the present invention will be shown in the following Table 1 in comparison with the physical property of the conventional diaphragms.

TABLE 1

| | Physical Property | | | | |
|---|---|---|---|---|---|
| Material | Density $\rho$ (g/cm$^2$) | Young's modulus E (dyne/cm$^2$) $\times 10^{11}$ | Young's modulus to density ratio $E/\rho$ (cm$^2 \times$ sec$^2$) $\times 10^{11}$ | Internal loss tan$\delta$ | Remarks |
| Foamed CFRP | 0.88 | 5.59 | 6.35 | 0.02 | Value in the orientation of fiber |
| CFRP | 1.5 | 12.74 | 8.49 | 0.015 | Value in the orientation of fiber |
| GFRP | 2.0 | 4.12 | 2.06 | 0.023 | Value in the orientation of fiber |
| Aluminum (Al) | 2.7 | 6.66–6.96 | 2.58 | 0.002 | |
| Paper | 0.5 | 0.2 | 0.4 | 0.05 | |

The one described as foamed CFRP is the one obtained by first impregnating the reinforcing carbon fibers with said plastics, and then by causing them to foam by the use of a foaming agent.

Figure 5:
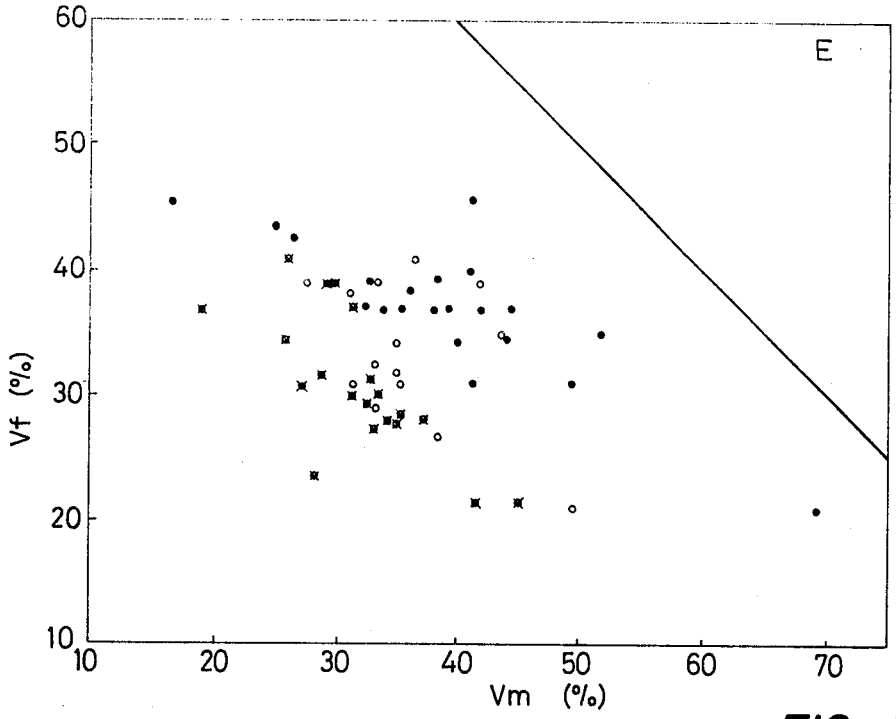
FIG. 5 is a graph showing the distribution of the Young's modulus E of plural samples of formed CFRP.
Figure 6:
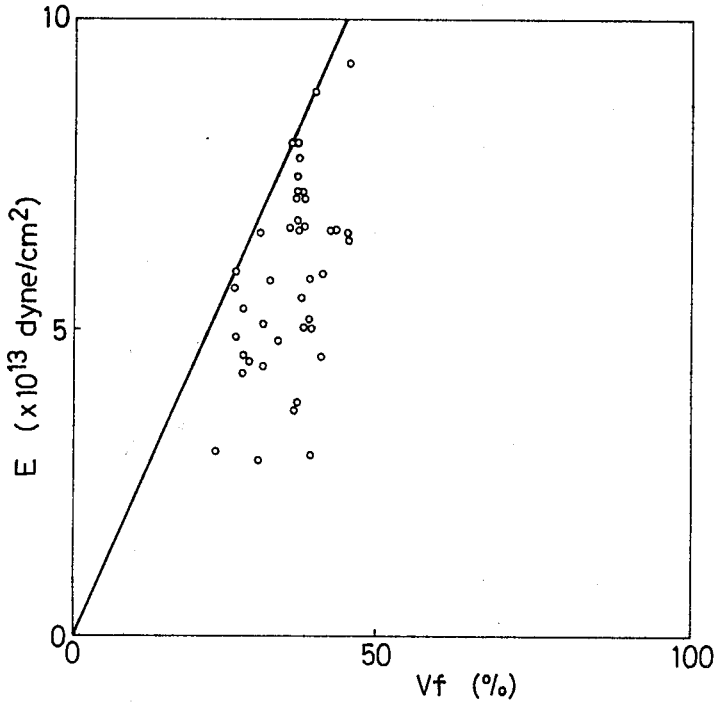
FIG. 6 is a graph showing the relationship between the volume density $V_f$ of fibers contained in foamed CFRP and Young's modulus E.

FIG. 5 shows the measured Young's modulus E data of plural samples. In this Figure, the axis of ordinates appears the volume density $V_f$ of the reinforcing carbon fibers, and the quadrature axis appears the volume density $V_m$ of the matrix resin (meaning the plastics content of the fiber-reinforced plastics). Black dots · represent the distribution of the samples of $E \geqq 6$ (x $10^{11}$ dyn/cm$^2$), and circles o represent the distribution of the samples of 5 (x $10^{11}$ dyn/cm$^2$) $\leqq E < 6$ (x $10^{11}$ dyn/cm$^2$), and the circles containing "x" represent the distribution of the samples of $E < 5$ (x $10^{11}$ dyn/cm$^2$). For example, in case $V_m = 30\%$ and $V_f = 30\%$, the remainder 40% portion of volume means cells. The line shown in the right upper portion of FIG. 5 is one connecting $\{(V_m = 100), (V_f = 0)\}$ and $\{(V_m = 0), (V_f = 100)\}$, and no further data are available on the upper right portion of this line. Also, FIG. 6 shows the relationship between the volume density $V_f$ of the reinforcing carbon fibers and Young's modulus E.

As will be apparent from the above Table 1, in case the diaphragm 6 is constructed by a composite board made of such material as foamed CFRP, there will occur a little drop in Young's modulus E as compared with the instance wherein the diaphragm 6 is made of aluminum (Al). However, because density $\rho$ is low, $E/\rho$ increases to about 2.5 times as large. Thus, diaphragm 6 will have a desirably broad frequency range of the sound reproducing. Also, this composite board has a large internal loss tan $\delta$, so that it is possible to obtain frequency characteristics having little peak or dip. As a result, the frequency characteristics of the diaphragm will become flat, and uneven colorification of the reproduced sound will be eliminated. Besides, the diaphragm can have a simplified structure, and can be fabricated at a low cost. Thus, the resulting diaphragm is desirable from many aspects.

Description has been made above with respect to the instance wherein the diaphragm 6 is made of a single kind of reinforcing fibers impregnated with a resin. It should be understood, however, that the diaphragm 6 may be made of a combination of two or more different kinds of reinforcing fibers impregnated with a resin.

Figure 7:
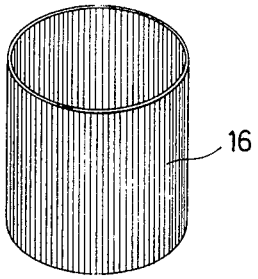
FIG. 7 is a diagrammatic perspective view of a voice coil bobbin of the loud speaker shown in FIG. 1.

By the way, the voice coil bobbin 7 used in the first embodiment is formed with a composite material which is prepared by impregnating, with cellular plastics, reinforcing fibers 16 with same materials, and in a same manner as used in the preparation of the abovesaid diaphragm 6 of the first embodiment, but in this instance the reinforcing fibers 16 are oriented, for example, axially of the voice coil bobbin 7 as shown in FIG. 7.

Figure 8:
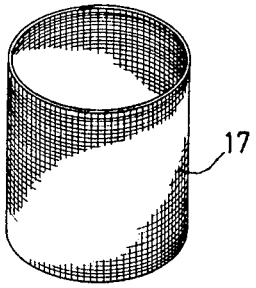
FIG. 8 is a diagrammatic perspective view of a modification of the voice coil bobbin of the loud speaker shown in FIG. 1.

It should be understood here that the reinforcing fibers used in the voice coil bobbin 7 is not limited to that in which the fibers are axially oriented. Instead, the reinforcing fibers may be as shown in, for example, FIG. 8, wherein the reinforcing fibers are arranged into a flat woven fabric 17 which then reinforces cellular plastics in a same manner as described above. Alternatively, the reinforcing fibers may be formed into a non-woven fabric which then reinforces cellular plastics.

Also, the cellular plastics used in the voice coil bobbin may be cellular plastics having closed cells, or it may be cellular plastics having open cells.

The physical property of the bobbin of the bobbin-forming material used in the abovesaid embodiment is compared in Table 2 with the physical property of the conventional bobbin-forming material.

TABLE 2

| Material | Physical Property: Density $\rho$ (g/cm$^2$) | Young's modulus E (dyne/cm$^2$) $\times 10^{11}$ | $E/\rho$ (cm$^2 \times$ sec$^2$) $\times 10^{11}$ | Eddy current | Remarks |
|---|---|---|---|---|---|
| Paper | 0.5 | 0.2 | 0.4 | None | |
| Synthetic resin (Polyamide) | 1.38 | 0.35 | 0.25 | None | |
| Aluminum | 2.7 | 6.66–6.96 | 2.58 | Yes | |
| Foamed CFRP | 0.88 | 5.59 | 6.35 | None | Value in the orientation of fiber |

As will be clear from Table 2, in case the voice coil bobbin is constructed with a composite material consisting of reinforcing carbon fibers and cellular plastics (foamed CFRP), Young's modulus E exhibits a little drop as compared with the instance wherein the bobbin is formed with aluminum. However, $E/\rho$ is about 2.5 times greater than that of the instance made of aluminum, and also density $\rho$ is small. Therefore, the resulting voice coil bobbin can be small in its thickness and light in weight, and can substantially satisfy the mechanical strength requirement, and is suitable for use in a loud speaker for large sound reproduction. Also, the abovesaid composite material is an insulator electrically, so that there is no fear for the development of eddy current unlike the conventional voice coil bobbin which is made of aluminum. Thus, such voice coil bobbin will give no adverse effect on the reproduced sound.

Figure 9:
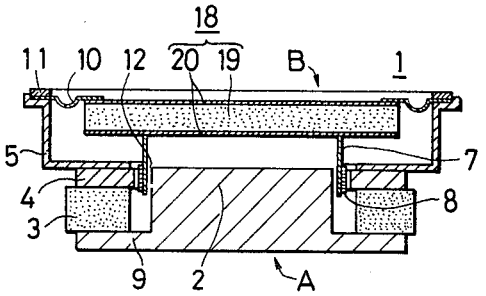
FIG. 9 is a diagrammatic vertical sectional view of a loud speaker, showing a second embodiment of the present invention.

FIG. 9 shows a second embodiment. For the sake of simplicity, parts similar to those shown in FIG. 1 are assigned similar reference numbers and symbols, and their explanation is omitted. The disk-shape diaphragm 18 in this second embodiment employs a core member 19 which is constructed by a composite material prepared with such cellular plastics and reinforcing fibers as those used in the construction of the diaphragm 6 of the first embodiment shown in FIG. 1. A skin member 20 which is formed with fiber-reinforced plastics, or light metal, or ceramics is bonded to each of the front and rear sides of the core member 19 to provide a sandwich structure of diaphragm. It should be understood here also that, at the time of preparing the cellular plastics, arrangement may be made to vary the degree of its forming so that the cells may be formed into closed cells or open cells.

Preferable material of the skin member 20 includes fiber-reinforced plastics, light metal and ceramics as stated previously. As the reinforcing fibers used in the fiber-reinforced plastics, there are such reinforcing material as carbon fibers, glass fibers and aromatic polyamide fibers. Also, light metal includes aluminum (Al), beryllium (Be) and boron (B). Ceramics include beryllium oxide (BeO), magnesium oxide (MgO), alumina ($Al_2O_3$) and silicon dioxide ($SiO_2$). A skin member 20 which is made of such material as listed above is bonded and fixed, under heat and pressure, to each side of the core member 19 which has been preliminarily coated with bonding agent on the surfaces of both sides thereof. Thus, a diaphragm 18 having said sandwich structure is constructed.

Figure 10:
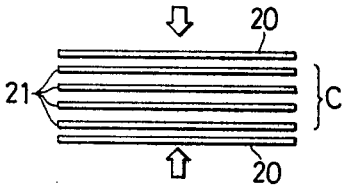
FIG. 10 is a diagrammatic explanatory illustration of a method of fabricating the diaphragm used in the loud speaker shown in FIG. 9.

In this latter embodiment, the diaphragm 18 has a sandwich structure as stated above. Accordingly, the diaphragm may be formed in the below-mentioned manner. That is, as shown in FIG. 10 for example, first, prepregnated sheets 21 of thermosetting resin reinforced by flat woven carbon fabric are prepared in its pre-cured state. At this time, into the thermosetting resin is introduced a foaming agent having a decomposition temperature lower than but close to the curing temperature of the resin. A plurality of these prepregnated sheets 21 are laminated one upon another to provide a laminated body C. Then, a skin member 20 which is made of, for example, resin-impregnated carbon fibers arranged in a single orientation is mounted on each side of the laminated body C, and the resulting assembly is subjected to a pressure while being heated to mold an integral diaphragm 18, while forming the cellular plastics during the molding process.

In this second embodiment, the composite material which forms the core member 19 of the diaphragm 18 may be made with such material as foamed CFRP. Accordingly, the diaphragm 18 having such core member 19 will exhibit characteristics similar to those exhibited by the diaphragm 6 of the first embodiment. Also, in case the skin member 20 is comprised of a ceramic material, this skin member 20 is reinforced by such core member 19. Thus, as compared with the conventional diaphragm made with only a single ceramic material, the resulting diaphragm 18 is easy and safe to handle. Furthermore, although aluminum (Al) diaphragm cannot have a substantially great thickness from the viewpoint of its efficiency. However, if foamed CFRP is employed, the diaphragm can be made to have a substantial thickness because of the small density $\rho$ of the foamed CFRP. Whereby, the flexural rigidity E·I of the diaphragm can be made large, and thus it is possible to suppress distortion of sound attributable to diaphragm to a low level.

Figure 11:
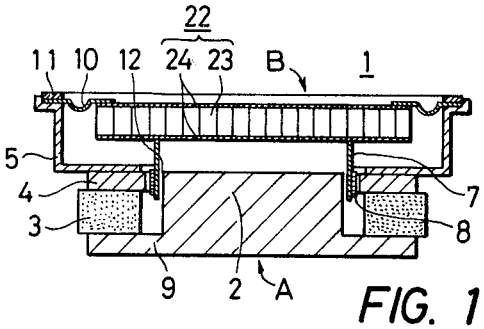
FIG. 11 is a diagrammatic vertical sectional view of a loud speaker, showing a third embodiment of the present invention.

FIG. 11 shows a third embodiment. Parts similar to those in FIG. 1 are given like reference numerals and symbols, and their explanation is omitted. The disk-shaped diaphragm 22 of this third embodiment has a honeycomb structure which is comprised of: a honeycomb core 23 made of aluminum and formed with a number of honeycomb-shaped cells, i.e. a number of small hexagonal cells; and skin members 24 are bonded to both sides of this honeybomb core 23 by a bonding agent such as bonding film. As the material of such skin members 24, there is used a composite material prepared with cellular plastics and reinforcing fibers to provide either a composite material having closed cells or open cells.

In this third embodiment, it should be understood that, by preparing the skin members 24 with such composite material as foamed CFRP, the resulting diaphragm 22 will exhibit characteristics similar to those exhibited by the diaphragm of the first embodiment. Moreover, the diaphragm 22 of this third embodiment has a honeycomb structure, and accordingly, it has many advantages such that it is light in weight and has a great flexural rigidity and will not develop its deformation during its vibration in use.

Figure 12:
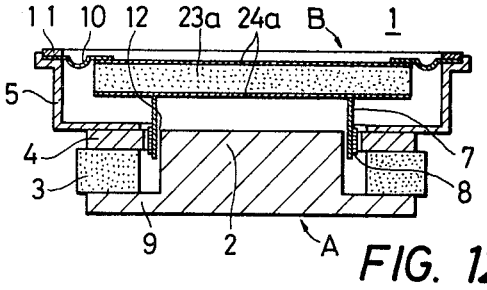
FIG. 12 is a diagrammatic vertical sectional view of a loud speaker provided with a diaphragm representing a modified embodiment of the diaphragm of the loud speaker shown in FIG. 11.

FIG. 12 shows a modification of the third embodiment. The diaphragm in this modification has a sandwich structure which is comprised of a core member **23*a* formed with cellular plastics such as foamed styrol resins and having, at both sides, skin members 24*a* prepared with the same material as that for the skin members 24, of the third embodiment shown in FIG. 11** and bonded thereto by a bonding agent. Other parts are same as those of the third embodiment, and they are given like reference numerals and symbols to omit their explanation.

What is claimed is:

1. An electro-acoustic transducer, comprising:

a vibration system having a diaphragm, a voice coil bobbin and a voice coil wound about the bobbin;

a magnetic circuit system forming a magnetic gap in which is positioned said voice coil; and a frame supporting, via a suspension member, said diaphragm, wherein at least one of the constituent members of said vibration system is comprised of a composite material of cellular plastics and reinforcing fibers integral with the cellular plastics.

2. An electro-acoustic transducer according to claim 1, in which said constituent member is the diaphragm.

3. An electro-acoustic transducer according to claim 1, in which said constituent member is the voice coil bobbin.

4. An electro-acoustic transducer according to claim 2, in which said diaphragm is made with a single board made of said composite material.

5. An electro-acoustic transducer according to claim 2, in which said diaphragm has a sandwich structure formed with a core member and at least one skin member bonded to a surface of said core member, and in which said core member is prepared with said composite material.

6. An electro-acoustic transducer according to claim 1, in which said reinforcing fibers having a diameter ranging from several micrometers to ten and several micrometers.

7. An electro-acoustic transducer according to claim 6, in which said reinforcing fibers are made into a woven fabric.

8. An electro-acoustic transducer according to claim 6, in which said reinforcing fibers are made into a non-woven fabric.

9. An electro-acoustic transducer according to claim 5, in which said skin member is one selected from the group consisting of fiber-reinforced plastics, light metal and ceramics.

10. An electro-acoustic transducer according to claim 9, in which said skin member is prepared with a fiber-reinforced plastics reinforced by fibers selected from the group consisting of carbon fibers, glass fibers and aromatic polyamide fibers.

11. An electro-acoustic transducer according to claim 9, in which said skin member is prepared with a light metal selected from the group consisting of aluminum, beryllium and boron.

12. An electro-acoustic transducer according to claim 9, in which said skin member is prepared with a ceramics selected from the group consisting of beryllium oxide, magnesium oxide, alumina and silicon dioxide.

13. An electro-acoustic transducer, comprising:

a vibration system having a diaphragm and a voice coil bobbin wound with a voice coil;

a magnetic circuit system forming a magnetic gap in which is positioned said voice coil; and a frame supporting, via a suspension member, said diaphragm, said diaphragm employing a composite material prepared with cellular plastics and its reinforcing fibers for constructing at least one constituent member of said diaphragm;

wherein said diaphragm has a sandwich structure formed with a core member and at least one skin member bonded to a surface of said core member, and wherein said skin member is prepared with said composite material.

14. An electro-acoustic transducer according to claim 13, in which said core member has a honeycomb structure.

15. An electro-acoustic transducer according to claim 13, in which said core member is prepared with cellular plastics.

16. An electro-acoustic transducer, comprising:

a vibration system having a diaphragm and a voice coil bobbin wound with a voice coil;

a magnetic circuit system forming a magnetic gap in which is positioned said voice coil; and a frame supporting, via a suspension member, said diaphragm, said diaphragm employing a composite material prepared with cellular plastics and its reinforcing fibers for constructing at least one constituent member of said diaphragm;

wherein said diaphragm has a sandwich structure formed with a core member and at least one skin member bonded to a surface of said core member, said core member being prepared with said composite material, and said skin member being prepared with a fiber-reinforced plastics reinforced by fibers selected from the group consisting of carbon fibers, glass fibers and aromatic polyamide fibers.

17. An electro-acoustic transducer, comprising:

a vibration system having a diaphragm and a voice coil bobbin wound with a voice coil;

a magnetic circuit system forming a magnetic gap in which is positioned said voice coil; and a frame supporting, via a suspension member, said diaphragm, said diaphragm employing a composite material prepared with cellular plastics and its reinforcing fibers for constructing at least one constituent member of said diaphragm;

wherein said diaphragm has a sandwich structure formed with a core member and at least one skin member bonded to a surface of said core member, said core member being prepared with said composite material, and said skin member being prepared with a ceramics selected from the group consisting of beryllium oxide, magnesium oxide, alumina and silicon dioxide.

18. An electro-acoustic transducer according to claim 16 or 17, in which said core member is prepared with a single sheet of said composite material.

19. An electro-acoustic transducer according to claim 16 or 17, in which said core member is prepared with a laminated sheet of said composite material.

20. An electro-acoustic transducer according to claim 13, 16 or 17, in which said cellular plastics is a thermoplastic resin selected from the group consisting of epoxy resin, unsaturated polyester resin, phenolic resin and polyimid resin, which is foamed by a foaming agent.

21. An electro-acoustic transducer according to claim 13, 16 or 17, in which said cellular plastics is a thermoplastic resin selected from the group consisting of polyamide resin, polyethylene resin, polypropylene resin, polystyrene resin, polyvinyl chloride resin and acrylonitrile-butadiene-styrene resin, which is foamed by a foaming agent.

22. An electro-acoustic transducer according to claim 13, 16 or 17, in which said reinforcing fibers are high modulus fibers selected from the group consisting of carbon fibers, glass fibers, silicon carbide fibers, boron fibers, graphite fibers and aromatic polyamide fibers.

23. An electro-acoustic transducer according to claim 13, 16 or 17, in which said reinforcing fibers are a combination of high modulus fibers selected from the group consisting of carbon fibers, glass fibers, silicon carbide fibers, boron fibers, graphite fibers and aromatic polyamide fibers.

24. An electro-acoustic transducer according to any one of claims 1, 13, 16, and 17, in which said composite material contains cellular plastics having closed cells.

25. An electro-acoustic transducer according to any one of claims 1, 13, 16, and 17, in which said composite material contains cellular plastics having open cells.

* * * * *

UNITED STATES PATENT AND TRADEMARK OFFICE

CERTIFICATE OF CORRECTION

PATENT NO. : 4,410,768

DATED : October 18, 1983

INVENTOR(S) : Akira Nakamura

It is certified that error appears in the above-identified patent and that said Letters Patent are hereby corrected as shown below:

Column 10, lines 20-21, change "thermoplastic" to --thermosetting--.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*